US005314121A

United States Patent [19]

Buss et al.

[11] Patent Number: 5,314,121

[45] Date of Patent: May 24, 1994

[54] DISCHARGE DEVICE

[75] Inventors: Grahame Y. Buss; Wai L. Loh, both of Chester, United Kingdom

[73] Assignee: Shell Oil Company, Houston, Tex.

[21] Appl. No.: 744,052

[22] Filed: Aug. 12, 1991

[30] Foreign Application Priority Data

Aug. 29, 1990 [GB] United Kingdom ..... 9018858

[51] Int. Cl.[5] ..... B65B 3/22

[52] U.S. Cl. ..... 239/553.3; 239/548; 239/553.5; 239/590.3; 239/590.5; 141/286

[58] Field of Search ..... 239/552-553.5, 239/590-590.5, DIG. 19, 548; 222/189; 141/286

[56] References Cited

U.S. PATENT DOCUMENTS

| | | | |
|---|---|---|---|
| 2,551,114 | 5/1951 | Goddard | 239/548 |
| 2,775,486 | 12/1956 | King | 222/189 |
| 3,295,563 | 1/1967 | Laya et al. | 141/286 |
| 3,698,452 | 10/1972 | Waxlax | 239/548 |
| 3,805,856 | 4/1974 | McLennand | 141/286 |
| 4,513,797 | 4/1985 | Tompkins, Jr. | 141/286 |
| 5,094,278 | 3/1992 | Arao et al. | 239/590.5 |

FOREIGN PATENT DOCUMENTS

| | | | |
|---|---|---|---|
| 1508813 | 4/1978 | United Kingdom | C08F 6/16 |
| 1537560 | 12/1978 | United Kingdom | B01D 19/00 |
| 2022434 | 12/1979 | United Kingdom | A61M 1/03 |

*Primary Examiner*—Andres Kashnikow
*Assistant Examiner*—Lesley D. Morris

[57] ABSTRACT

A discharge device for reducing foaming of liquid flowing from a conduit (3) into a body of liquid. The discharge device (3) contains at least a porous permeable body (6) including a core (12) and an annular layer (15). To cause during normal operation liquid to leave the porous permeable body (6) in the form of a liquid bell (18) the resistance to flow through the porous permeable body (6) in the direction of its central longitudinal axis (9) is larger than the resistance to flow through the porous permeable body (6) in lateral direction towards the side surface (17) of the porous permeable body.

10 Claims, 2 Drawing Sheets

DISCHARGE DEVICE

FIELD OF THE INVENTION

The invention relates to reducing foaming of liquid which flows out of a discharge device into a body of liquid in a tank.

BACKGROUND OF THE INVENTION

When the liquid flows out of a discharge deice and splashes into a body of liquid foam can be generated. Generally the amount of foam generated increases with increasing flow rate at which the liquid is discharged when other conditions are not changed. The generated foam can occupy a considerable amount of the volume of the tank into which the liquid is discharged, so that after settling out of the foam only a limited amount of liquid is present in the tank. This problem occurs for example when a fuel tank of a car is filled with diesel fuel at normal filling rate. The amount of foam generated in the tank during filling limits the fuel capacity of the tank considerably as in general about 10–20% by volume of a diesel tank is occupied by foam.

It is an object of the invention to overcome this problem which occurs during the flow of fluid from a conduit into a body of fluid.

SUMMARY OF THE INVENTION

To this end the discharge device according to the present invention comprises a conduit having an outlet end and a porous permeable body joined to the outlet end of the conduit so that the central longitudinal axis of the porous permeable body extends in the direction of fluid flow through the outlet end during normal operation, wherein the resistance to flow through the porous permeable body in the direction of its central longitudinal axis is larger than the resistance to flow through the porous permeable body in lateral direction.

DESCRIPTION OF THE PREFERRED EMBODIMENT(S)

Figure 1:
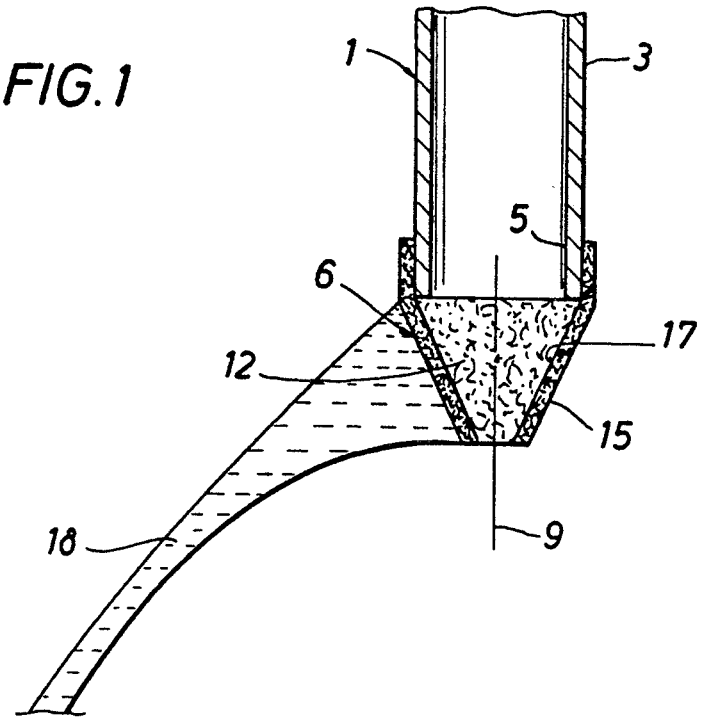
FIG. 1 shows schematically a longitudinal cross-section of the discharge device according to the invention.

The resistance to flow through the porous permeable body in lateral direction is the average resistance to flow through the body along flow paths which terminate on the side surface of the permeable body. The resistance to flow through the porous permeable body in the direction of its central longitudinal axis is suitably between 5 and 10 times the resistance to flow through the porous permeable body in lateral direction.

Liquid tends to flow along a path of least resistance, thus liquid flowing through a porous permeable body having a uniform permeability selects the shortest flow path. If the porous permeable body is an elongated body, the bulk of the liquid entering the body in the direction of its central longitudinal axis will leave the body through the side surface and only a small amount will flow along the central longitudinal axis. A closer look at the liquid flowing through the side surface reveals that the liquid preferably leaves the body close to the entry surface of the body. Thus the greater part of the liquid leaves the porous permeable body through a small area, therefore at a high velocity.

The liquid leaves the porous permeable body as a thin laminar sheet of liquid, which sheet extends radially. Under the influence of surface tensions the sheet curves in the direction of the central longitudinal axis at some distance away from the body. The sheet is continuous until the edge where the sheet breaks in droplets or recombines to form a substantially cylindrical jet. The shape of the sheet is bell-shaped. In the specification the term "liquid bell" will be used to denote the sheet of liquid which leaves the porous permeable body and which has the shape of a bell.

Entrainment of air with such a liquid bell is considerably less than the air entrainment of a liquid stream out of a normal outlet.

The size of the liquid bell in radial direction can be reduced by reducing the flowrate of the liquid leaving the outlet end. Another way of reducing the radial size is to distribute the liquid leaving the porous permeable body over a larger part of the side surface.

Liquid leaving the porous permeable body can be distributed evenly over the side surface. This is obtained by a porous permeable body comprising a core and an annular layer having a smaller permeability than the core, suitably the pore size of the annular layer is between 0.05 and 0.10 times the pore size of the core. In the permeable body the resistance to flow is dependent on the velocity, the smaller permeability of the annular layer forces the liquid to distribute itself evenly over the layer. In this way the surface area through which the liquid leaves the porous permeable body is enlarged and consequently the liquid velocity is decreased; thus the size of the liquid bell in radial direction is reduced.

The invention will now be described by way of example in more detail with reference to the accompanying drawings, wherein With reference to FIGS. 1, 2, and 3, discharge device comprises a conduit 3 having an outlet end 5 and a porous permeable body 6 (fustro-conically shaped in FIGS. 1 and 2 and cylindrically shaped in FIG. 3) joined to the outlet end 5 of the conduit 3 so that the central longitudinal axis 9 of the porous permeable body 6 extends in the direction of fluid flow through the outlet end during normal operation. The porous permeable body 6 is secured to the outlet end 5 by suitable fastening means (not shown).

The resistance to flow through the porous permeable body 6 in the direction of its central longitudinal axis 9 is suitably between 5 and 10 times the resistance to flow through the porous permeable body in lateral direction.

The porous permeable body 6 includes a core 12 and an annular layer 15 arranged around the side surface 17 of the core 12. The permeability of the annular layer 15 is between 0.05 and 0.10 times the permeability of the core 12.

During normal operation, liquid flows through the conduit 3 towards the porous permeable body 6. As the resistance to flow through the porous permeable body 6 in the direction of its central longitudinal axis 9 is large, liquid will flow preferentially laterally in the direction of the side surface 17. The liquid leaves the porous permeable body 6 in the form of a liquid bell 18, which liquid bell 18 is substantially axi-symmetric. For the sake of clarity one half of its cross-section has not been shown and the thickness has been exaggerated.

The discharge device 1 is arranged in a filling tube 20 (see FIG. 2) of a tank 22 to allow filling the tank 22 with liquid body 23. For the sake of clarity FIG. 2 is not to scale.

The ranges and limitations provided in the instant specification and claims are those which are believed to particularly point out and distinctly claim the instant invention. It is, however, understood that other ranges and limitations that perform substantially the same function in substantially the same way to obtain substantially the same result are intended to be within the scope of the instant invention as defined by the instant specification and claims.

EXAMPLES

The invention will be described by the following example(s) which are provided for illustrative purposes and are not to be construed as limiting the invention:

EXPERIMENT 1, NOT ACCORDING TO THE INVENTION

A diesel discharge device was used to fill a tank having an internal volume of 20 liters with diesel fuel. The outlet end of the discharge device had an internal diameter of 20 mm and extended 10 cm in the tank and projected vertically downward. The tank was filled at a filling rate of 35 liters/minute until the total level of diesel fuel plus foam reached the 19.5 liters mark. Filling was then stopped and the foam was allowed to settle out, whereafter the final fuel level was measured. The tank was filled with 15 liters of diesel fuel, being 75% of the internal volume.

EXPERIMENT 2, ACCORDING TO THE INVENTION

The porous permeable body described with reference to FIG. 1 was fixed to the outlet end of the diesel discharge device used in experiment 1 in the described manner. The porous body used in the experiment was a cylindrical body, comprising a core made of metal foam, of which the pore volume is 90% of the total volume and the average pore size is 0.8 mm, the annular layer consisted of a layer of 100 mesh stainless steel. The porous permeable body had a length of 20 mm and a diameter of 20 mm. As in experiment 1 the outlet end extended vertically 10 cm in the 20 liters tank. The tank was filled at a filling rate of 35 liters/minute until the total level of diesel fuel plus foam reached the 19.5 liters mark. Filling was then stopped and the foam was allowed to settle out, whereafter the final fuel level was measured. The tank was filled with 18.5 liters of diesel fuel being 95% of the internal volume.

The above experiments clearly indicate the effect of using the discharge device according to the invention. An explanation of the effect is that the jet of liquid leaving the conventional outlet is turbulent and has on its surface undulations that entrain air into the body of the fluid. The sheet of liquid that issues from the discharge device according to the invention is laminar and entrains almost on air.

Figure 2:
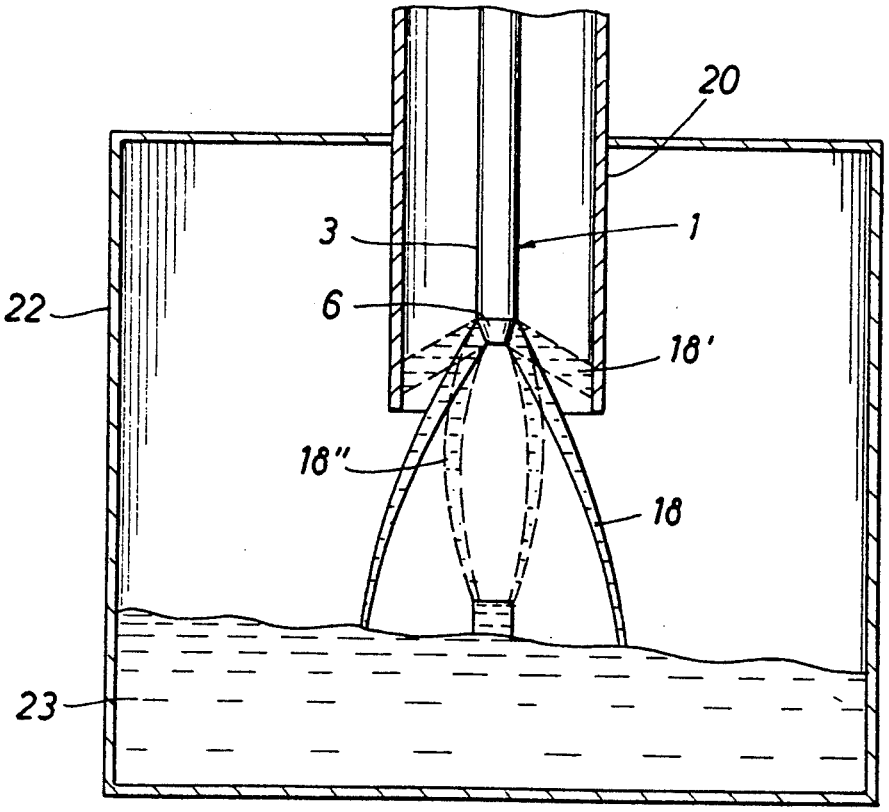
FIG. 2 shows schematically a partial cross-section of the discharge device according to the invention during operation.
Figure 3:
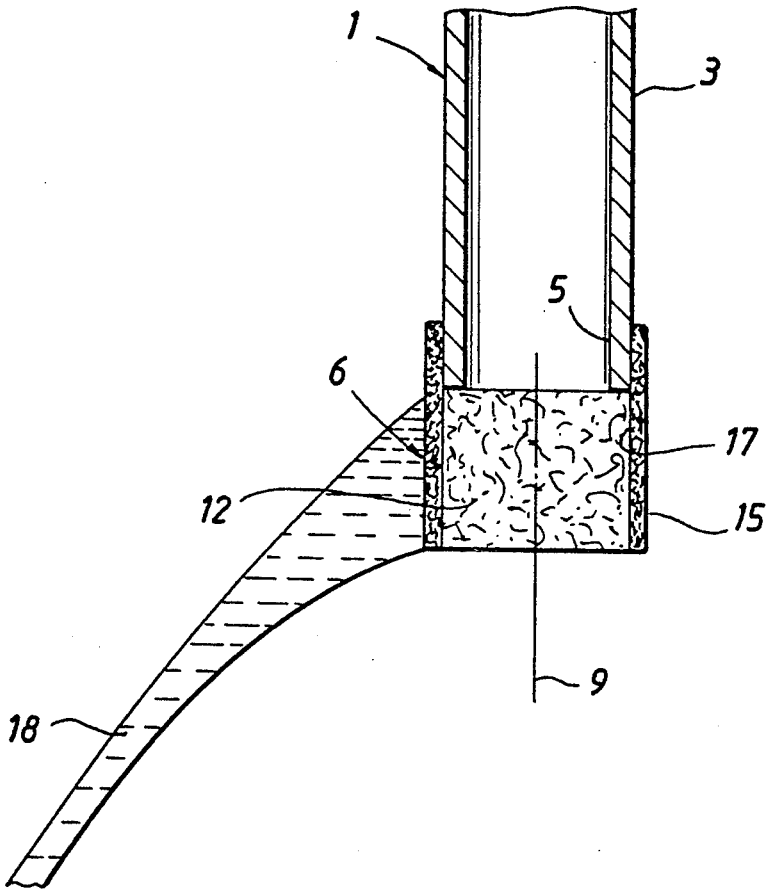
FIG. 3 shows schematically a longitudinal cross-section of another embodiment of the discharge device according to the invention.

The resistance to flow of the porous permeable body 6 is s selected in relation to the liquid discharge rate that the liquid bell has the shape of the liquid bell as indicated with reference numeral 18 in FIG. 2. When the resistance to flow is too low, the liquid bell is too wide and liquid comes in contact with the wall of the filling tube 20 as shown for liquid bell 18', liquid colliding with the filling tube can be thrown upwardly and contribute to spilling, therefore one should avoid a too wide liquid bell. On the other hand, when the resistance to flow is too high, the liquid bell is so narrow that it will join a jet liquid a shown for liquid bell 18". Such a jet will entrain air, and therefore a too narrow liquid bell should be avoided.

Suitably the ratio of the length of the porous permeable body to the diameter of the largest end surface is between 0.5 and 1.0.

In the discharge device as shown in FIGS. 1 and 2 the porous permeable body was fustro-conically shaped tapered in the direction of fluid flow in normal operation, in an alternative embodiment of the invention the porous permeable body is cylindrical.

In case the porous permeable body comprises a core and an annular layer, suitably, the ratio of the thickness of the annular layer to the diameter of the largest end surface is between 0.01 and 0.10.

The pores of the core have suitably a diameter between 0.10 and 1.0 mm, and the pores of the annular layer have a diameter between 0.05 to 0.10 times the diameter of the pores of the core.

The core can comprise a metal foam having interconnected cells, or a sintered material such as sintered plastic or sintered metal, and the annular layer can comprise wire gauze or a sintered layer of sintered particles smaller than the particles of the core or a compressed metal foam.

What is claimed is:

1. A discharge device comprising a conduit having an outlet end and a porous permeable body having a central longitudinal axis, wherein said porous permeable body is joined to the outlet end of the conduit so that the central longitudinal axis of the porous permeable body extends in the direction of fluid flow through the outlet end during normal operation, wherein resistance to flow through the porous permeable body in the direction of its central longitudinal axis is larger than resistance to flow through the porous permeable body in a lateral direction; wherein the porous permeable body includes a core having pores and a side surface, and the core is connected to an annular layer having pores, and said annular layer is arranged around the side surface of the core, and wherein the permeability of the annular layer is smaller than the permeability of the core.

2. The discharge device of claim 1, wherein the porous permeable body is fustro-conically shaped, tapering in the direction of fluid flow during normal operation.

3. The discharge device of claim 1, wherein the porous permeable body is fustro-conically shaped, tapering in the direction of fluid flow during normal operation and the ratio of the length of the porous permeable body to the diameter of the largest end surface is between 0.5 and 1.0.

4. The discharge device of claim 2, wherein the ratio of the thickness of the annular layer to the diameter of the largest end surface is between 0.01 and 0.10.

5. The device of any one of claims 2, wherein the pores of the core have a diameter between 0.10 and 1.0 mm.

6. The device of claim 2, wherein the pores of the annular layer have a diameter between 0.05 to 0.10 times the diameter of the pores of the core.

7. The device of claim 2, wherein the core comprises a metal foam having interconnected cells.

8. The device of claim 2, wherein the annular layer comprises wire gauze.

9. A discharge device comprising a conduit having an outlet end having an end surface and having a porous permeable body having a central longitudinal axis, and having a core having pores and a side surface, wherein said core is connected to an annular layer having pores wherein said annular layer is arranged around the side surface of the core, and wherein the permeability of the annular layer is smaller than the permeability of the core and wherein the porous permeable body is fustroconically shaped, tapering in the direction of fluid flow during normal operation and wherein the ratio of the thickness of the annular layer to the diameter of the largest end surface is between 0.01 and 0.10 and wherein the pores of the core have a diameter between 0.10 and 1.0 mm and wherein the pores of the annular layer have a diameter between 0.05 to 0.10 times the diameter of the pores of the core and wherein the core comprises a metal foam having interconnected cells and the annular layer comprises wire gauze and the porous permeable body is joined to the outlet end of the conduit so that the central longitudinal axis of the porous permeable body extends in the direction of fluid flow through the outlet end during normal operation, wherein resistance to flow through the porous permeable body in the direction of its central longitudinal axis is larger than resistance to flow through the porous permeable body in a lateral direction.

10. The discharge device of claim 1 wherein the porous permeable body is cylindrical.

* * * * *